US005465500A

United States Patent [19]

Nammoto

[11] Patent Number: 5,465,500

[45] Date of Patent: Nov. 14, 1995

[54] MAGNETIC POINT IDENTIFIER

[76] Inventor: Yuji Nammoto, 14790 SW. 184 St., Miami, Fla. 33187

[21] Appl. No.: 250,157

[22] Filed: May 27, 1994

[51] Int. Cl.[6] ..... B25H 7/04

[52] U.S. Cl. ..... 33/666; 33/677; 33/670

[58] Field of Search ..... 33/666, 626, 628, 33/670, 671, 676, 677, 678, DIG. 1

[56] References Cited

U.S. PATENT DOCUMENTS

| | | | |
|---|---|---|---|
| 2,526,528 | 10/1950 | Zickler et al. | 33/677 |
| 2,734,272 | 2/1956 | Brown | 33/666 |
| 2,844,977 | 7/1958 | Morse | 33/628 |
| 4,597,185 | 7/1986 | Ury | 33/628 |

*Primary Examiner*—Christopher W. Fulton
*Attorney, Agent, or Firm*—Malloy & Malloy

[57] ABSTRACT

A magnetic point identifier to be used in the construction of structures wherein a hole is to be formed at a specific point in a surface of the structure, the identifier including a small magnetic element to be disposed to correspond the specific point, and including an indicator frame with a metallic, magnetically attractive pointer suspended therein. The indicator frame includes a base portion, an upstanding support member extending upwardly from the base portion, and a horizontal suspension arm which extends outwardly from the upstanding support member so as to overly the base portion which has a tapered free distal end to enable positioning of the indicator frame within a corner. Suspended from a second end of the horizontal suspension arm is the pointer which is disposed such that a pointed indicator end freely hangs beneath the horizontal suspension arm to point out the location of the magnetic element positioned to correspond the hole, the pointer further being disposed so as to be downwardly urged into the surface of the structure and form an indicating indentation in the surface of the structure wherein a drill or other hole making mechanism can be started for accurate making of the hole.

8 Claims, 1 Drawing Sheet

MAGNETIC POINT IDENTIFIER

BACKGROUND OF THE INVENTION

1. Field of the Invention

The present invention relates to a magnetic point identifier preferably for use in the construction of structures such as aircrafts, wherein a hole must be located and formed at a specific marked point in a surface of the structure, the marked point not being visible from an exterior of the surface of the structure portion to be marked, so as to clearly identify the location where the hole is to be formed.

2. Description of the Related Art

When building or repairing a structure such as an aircraft, a builder is often required to make precise holes in a surface of the aircraft. Frequently, however, the markings or guide points on the aircraft which indicate the required location of the hole are concealed on an interior or hard to reach area of the aircraft such that it would be substantially beneficial to be able to form the hole from an outer surface. Similarly, when attempting to align holes to be formed in a new part with a previously formed opening in a secured part, it can be quite difficult to overlay the new part in the appropriate orientation while marking the necessary location for a hole to be formed which corresponds the covered up hole of the assembled part. Accordingly, there is a need for a device which will enable a user to pinpoint an exact location where a hole should be formed when the precise location of the opening cannot be visibly be determined.

In the related art, there are numerous devices which employ magnets for the purpose of locating a point on a surface. These various devices are, however, either quite expensive or cumbersome such that they would not be effective for rapid and frequent use. Further, a majority of these devices merely point to a spot and do not provide for an accurate mark. Specifically, most devices which are commonly employed in the art will provide a pin which points to the area in which the hole should be made, but require that the user mark the actual surface with a pen or a marker. Such a procedure can lead to inaccuracies in the precise marking location as a user is required to estimate the exact pointed location of the hole locator and draw it in with the marker. Further, a drawn in marking will not provide an accurate guide point for a drill or other hole making mechanism at which the hole is to be made such that precise alignment without slippage will be difficult.

SUMMARY OF THE INVENTION

The present invention is directed to a magnetic point identifier which is to be used in the construction of structures such as aircrafts wherein a hole must be formed at a specific point in a surface of the structure. Included as part of the identifier is a small magnetic element which will be positioned to correspond a specific point in the surface of the structure so as to provide necessary alignment of the hole to be made. In order to indicate and identify the location of the magnetic element, the identifier includes a metallic, magnetically attractive pointer which has a suspension end and a pointed indicator end. The pointer is included within an indicator frame having a base portion, an upstanding support member, and a horizontal suspension arm. Specifically, the base portion includes a free distal end and a proximal end, the upstanding support member extending upwardly from the proximal end. The horizontal suspension arm which has a first end and a second end is secured to the upstanding support member along its first end and extends outwardly from an upper end of the upstanding support member so as to overhang the base portion. Included on the second end of the horizontal suspension arm are suspension means which swingably hold the pointer, at its suspension end, such that the indicator end of the pointer will freely hang beneath the suspension arm in indicating attraction with the magnetic element. Accordingly, the indicator end of the pointer will be attracted to the location of the magnetic element thereby pinpointing the location in which the hole is to be made. Finally, actuation means are included to push down upon the suspension end of the pointer in such a manner that the pointer and the horizontal suspension arm are downwardly biased until the pointed indicator end of the pointer contacts the surface of the structure and makes an indicating indentation in the surface of the structure. This indicating indentation serves as a guide to show the precise location where the hole should be made, as well as provides a readily ascertainable starting point at which a drill or other hole forming mechanism is positioned.

It is an object of the present invention to provide a magnetic point identifier which will enable accurate indication of a location at which to form a hole, when a marking or alignment hole to which the new hole must be referenced is not readily visible.

A further object of the present invention is to provide a point identifier which in addition to indicating the location at which a hole should be made will also provide a visible and ascertainable marking such that complete accuracy at the hole formation point can be assured.

Still another object of the present invention is to provide a magnetic point identifier which is cost-effective to utilize and manufacture and which is structured to provide a guide marking wherein a drill or other hole forming mechanism can be started.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the figures, the present invention is directed towards a magnetic point identifier, generally indicated as 10. The point identifier 10 is adapted primarily for use in the construction of structures such as aircrafts wherein a hole must be formed at a specific point in a surface A of the aircraft. Specifically, when forming the aircraft overlying pieces A & B must be aligned such that fastener or like holes formed therein correspond one another. Also, often the markings which indicate the proper location of a hole within a surface A of the aircraft are concealed on an interior surface of the aircraft rather than an exposed exterior surface wherein the hole can actually be drilled. Accordingly, in such circumstances, the hidden point wherein the hole is to be formed must be located and identified such that the hole can be conveniently made from an exterior or exposed surface.

Figure 1:
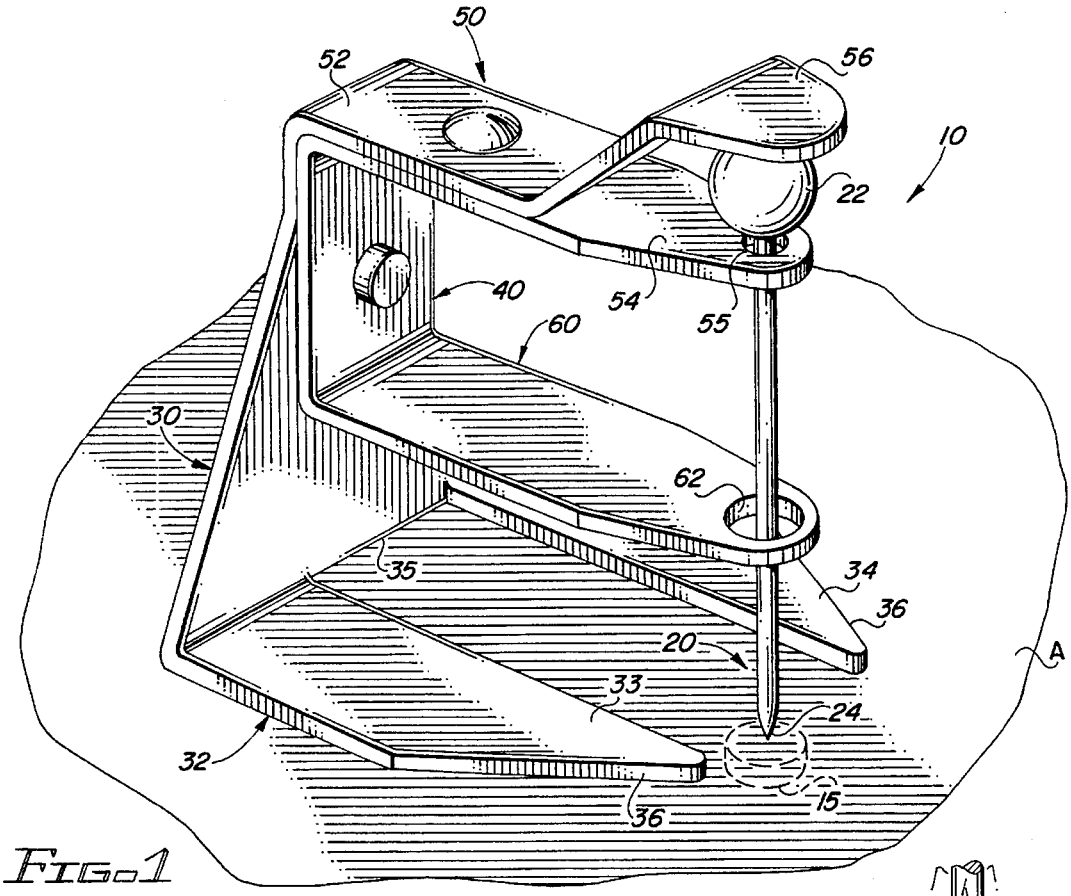
FIG. 1 is a front perspective view of the magnetic point identifier of the present invention.
Figure 2:
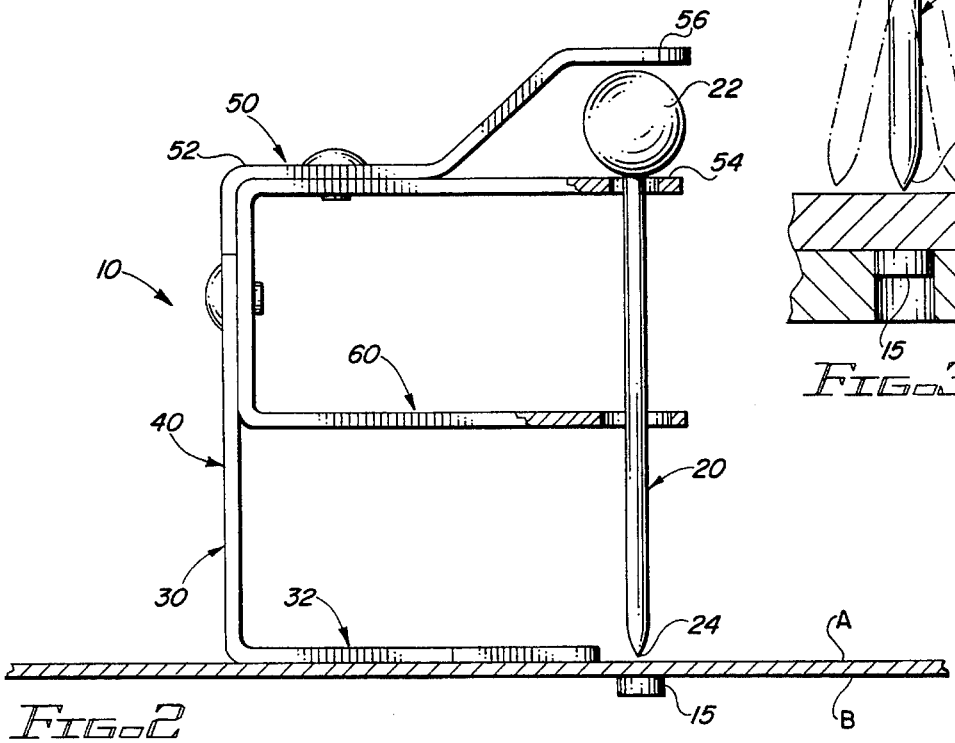
FIG. 2 is a side view of the magnetic point identifier of the present invention.

Included as part of the magnetic point identifier 10 is a small magnetic element 15 which is to be positioned to correspond the specific point in the surface A of the aircraft wherein the hole is to be formed. This magnetic element 15 will be substantially small so as to allow precise positioning, and can include an adhesive surface to facilitate positioning on the surface of the aircraft. As detailed in FIGS. 2 & 3, the magnetic element 15 can be positioned to underlie a lower surface B which provides a guide for the specific point wherein the hole is to be formed, or can be positioned directly within a corresponding hole B' in the lower surface B.

Additionally, the magnetic point identifier 10 includes a metallic, magnetically attractive pointer 20, with a suspension end 22 and a pointed indicator end 24. The metallic magnetically attractive pointer 20 is suspended from its suspension end 22, in an indicator frame 30. In particular, the indicator frame 30 includes a base portion 32, an upstanding support member 40, and a horizontal suspension arm 50, all of which can be separately or integrally formed with one another. The base portion 32 has a free distal end 36 and a proximal end 35 from which the upstanding support member 40 upwardly extends. Preferably, the upstanding support member 40 is substantially perpendicularly disposed relative to the base portion 32. Further, the base portion 32 will preferably include a pair of spaced, co-planar panels 33 and 34 which extend from the upstanding support member 40. Each of these panels 33 and 34 is outwardly tapered at the free distal end 36 thereof, such that the base portion 32 can be pushed into a corner of at least 90° to enable proper marking and identification of the point within that corner.

Figure 3:
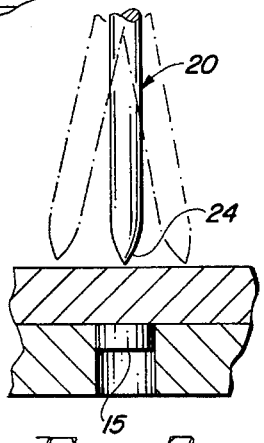
FIG. 3 is an isolated view illustrating the functioning of the indicator end of the pointer of the present invention.

Extending outwardly from an upper end of the upstanding support member 40 is the horizontal suspension arm 50. The horizontal suspension arm 50 includes a first end 52 and a second end 54 and is positioned so as to substantially overhang the base portion 32. In particular, the second end 54 of the suspension arm 50 extends outwardly from the support member 40 beyond the base portion 32. Disposed in the second end 54 of the horizontal suspension arm 50 are suspension means which swingably hold the pointer 20 such that the indicator end 24 of the pointer 20 will freely hang beneath the horizontal suspension arm 50 in indicating attraction with the magnetic element 15. Preferably, the suspension means includes an aperture 55 formed in the second end 54 of the horizontal suspension arm 50, the aperture 55 being sized to receive the pointer 20 therethrough and supportably hold the pointer 20 at its suspension end 22. In such suspended positioning, as the base portion 20 is slid over the surface A of the structure in the proximity of the magnetic element 15, the pointed indicator end 24 of the pointer 20 will be attracted to the magnetic element 15 and will point directly to the magnetic element 15, as illustrated in FIG. 3, thereby locating the specific point wherein the hole is to be formed.

So as to precisely indicate and identify the precise point wherein the hole in the surface of the aircraft or other structure is to be formed, actuation means are included to push the pointed indicator end 24 of the pointer 20 into the surface of the structure. In particular, the actuator end will push down upon the suspension end 22 of the pointer, thereby downwardly biasing the horizontal suspension arm 50 and downwardly urging the pointer 20 in such a manner that the pointed indicator end 24 will contact the specific point on the surface of the aircraft and make an indicating indentation within the surface of the aircraft. The indicating indentation is formed so as to be permanently and precisely visible and also functions as a guide point wherein a drill or other hole making mechanism can be positioned to start the precise hole making.

In the preferred embodiment, the actuation means are in the form of an overlying panel 56 which extends from the horizontal suspension arm 50 and overlies the suspension end 22 of the pointer 20. This overlying panel 56 provides an appropriate surface whereby a user can push thereon and cause the downward movement of the pointer 20 into the surface of the aircraft or other structure so as to make the indicating indentation. Additionally, the overlying panel 56 functions to maintain the pointer 20 properly disposed in indicating position if the indicator frame 20 is held an inverted position. Accordingly, the point identifier 10 can be utilized in a circumstance wherein the indicator frame 30 is held upside down. Also, the overlying panel 56 can be removable or pivoted out of place from its overlying orientation above the suspension end 22 of the pointer 20 so as to enable removal of the pointer 20 from its suspended position within the horizontal suspension arm 50, and enabling the pointer 20 to be replaced with a new pointer 20 should it become bent or otherwise damaged. Therefore, after extensive use of the magnetic point identifier 10, if the pointer becomes worn or damaged, the entire identifier 10 need not be replaced, but rather the pointer 20 alone can be replaced.

Also in the preferred embodiment, the indicator frame 30 includes a guide bracket 60 extending from a central portion of the upstanding support member 40. The guide bracket 60 is disposed so as to extend between the base portion 32 and the horizontal suspension arm 50, and includes a collar opening 62 formed therein to receive the pointer 20 therethrough. The collar opening 62 will receive the pointer 20 therethrough so as to limit radial movement of the pointer 20, and enable the magnetic point identifier 10 to be utilized when the indicator frame 30 is disposed sideways or at an angle. Further, the collar opening 62 function as a support for the pointer 20 such that upon downward urging of the pointer 20, bending or buckling of the pointer 20 will be substantially prevented. In addition to the guide bracket 60, supportably holding the pointer 20, the pointer 20 is to be substantially strong and of a sufficient diameter to prevent substantial deformation thereof upon downwardly urging the pointer into the surface of the aircraft or other structure, thereby enabling the pointer 20 to be effectively utilized in various material surfaces of the structure to form the indicating indentation.

What is claimed is:

1. To be used in the construction of structures wherein a hole must be formed at a specific point in a surface of the structure, a magnetic point identifier comprising:

a small magnetic element to be disposed to correspond to the specific point in the surface of the structure, a metallic, magnetically attractive pointer, said pointer including a suspension end and a pointed indicator end, an indicator frame, said indicator frame including a base portion, an upstanding support member, and a horizontal suspension arm, said base portion including a free distal end and a proximal end, said upstanding support member extending upwardly from said proximal end, said horizontal suspension arm including a first end and a second end, and being secured to said upstanding support member at said first end so as to extend outwardly from an upper end of said upstanding support member and overhang said base portion, said second end of said horizontal suspension arm including suspension means structured and disposed to swingably hold said pointer, at said suspension end of said pointer, such that said indicator end of said pointer freely hangs beneath said horizontal suspension arm in indicating attraction with said magnetic element so as to indicate the precise location of said magnetic element, and actuation means structured and disposed to push down on said suspension end of said pointer so as to downwardly bias said horizontal suspension arm and downwardly urge said pointer, such that said pointed indicator end of said pointer contacts the specific point in the surface of the structure and makes an indicating indentation in the surface of the structure.

2. A magnetic point identifier as recited in claim 1 wherein said pointer is substantially strong and of a sufficient diameter to prevent deformation thereof upon downwardly urging said pointer into the surface of the structure.

3. A magnetic point identifier as recited in claim 1 wherein said suspension means of said horizontal suspension arm includes an aperture formed in said horizontal suspension arm wherethrough said pointer is disposed.

4. A magnetic point identifier as recited in claim 1 wherein said actuation means are moveable to enable said pointer to be removed from said horizontal suspension arm and replaced with a new pointer.

5. A magnetic point identifier as recited in claim 1 wherein said actuation means includes an overlying panel extending from said horizontal suspension arm so as to overly said suspension end of said pointer and maintain said pointer disposed in and indicating position upon said indicator frame being held in an inverted position.

6. A magnetic point identifier as recited in claim 1 further including a guide bracket extending from said upstanding support member, said guide bracket include a collar opening disposed to receive said pointer therethrough.

7. A magnetic point identifier as recited in claim 1 wherein said free distal end of said base portion is outwardly tapered so as to enable said base and accordingly said indicator end of said pointer to be fitted into a corner section of the surface of the structure.

8. A magnetic point identifier as recited in claim 7 wherein said base portion includes a pair of spaced, co-planar panels extending from said upstanding support member.

* * * * *